US008177026B2

(12) United States Patent
Wood

(10) Patent No.: US 8,177,026 B2
(45) Date of Patent: May 15, 2012

(54) TREE STAND SAFETY BELT AND METHOD

(76) Inventor: Norman E. Wood, Keyser, WV (US)

( * ) Notice: Subject to any disclaimer, the term of this patent is extended or adjusted under 35 U.S.C. 154(b) by 392 days.

(21) Appl. No.: 12/383,032

(22) Filed: Mar. 19, 2009

(65) Prior Publication Data

US 2009/0236178 A1 Sep. 24, 2009

Related U.S. Application Data

(63) Continuation-in-part of application No. 11/513,610, filed on Sep. 1, 2006, now abandoned.

(51) Int. Cl.
*A62B 35/00* (2006.01)

(52) U.S. Cl. ..... 182/9

(58) Field of Classification Search ..... 182/9; 297/468
See application file for complete search history.

(56) References Cited

U.S. PATENT DOCUMENTS

| | | | | |
|---|---|---|---|---|
| 579,818 | A * | 3/1897 | Cooley | 297/468 |
| 2,741,412 | A * | 4/1956 | Hinkle | 297/467 |
| 4,226,474 | A * | 10/1980 | Rupert et al. | 297/484 |
| 4,951,778 | A * | 8/1990 | Halvorson | 182/9 |
| 5,624,135 | A * | 4/1997 | Symonds | 280/801.1 |
| 2005/0072632 | A1 * | 4/2005 | Muhich | 182/187 |

FOREIGN PATENT DOCUMENTS

CA 2285861 A1 * 1/2000

* cited by examiner

*Primary Examiner* — Alvin Chin Shue
(74) *Attorney, Agent, or Firm* — Gary P. Topolosky

(57) ABSTRACT

A Tree Stand Safety Belt device prevents a person (wearer/user) from falling out of a tree stand used for viewing or hunting wildlife. When properly positioned and securely attached, the device of this invention maintains substantially continuous contact of the wearer's back to a tree trunk. This contact not only provides a physical barrier to moving; that sense of contact also protects its wearer/user from experiencing height disorientation and possibly losing their balance. The device is designed for its wearer to use in either a sitting or standing position.

6 Claims, 9 Drawing Sheets

TREE STAND SAFETY BELT AND METHOD

CROSS-REFERENCE TO RELATED APPLICATION

This application is a continuation-in-part of application Ser. No. 11/513,610, filed on Sep. 1, 2006 and entitled "Tree Stand Safety Belt", the disclosure of which is fully incorporated by reference herein.

BACKGROUND OF INVENTION

1. Field of the Invention

The invention generally relates to safety equipment. More specifically, this invention relates to an improved fall protection safety belt for hunters in a tree stand. The invention further relates to a method for using such a tree stand safety belt.

2. Background

Every year, people are seriously injured or killed from falling out of tree stands used for hunting and/or the viewing of wildlife. There are devices utilized today that will stop a person from completely falling to the ground. These devices, however, can cause serious injury and death. The injury is a result of the sudden and violent stop of descent depending on the length of the tether. Injuries include minor contusions to fractures and suffocation. As a physician and father, the inventor wanted to ensure that his children could safely enjoy the viewing and hunting of wildlife from an elevated position, such as a tree stand.

As reported by Richard Holdcraft in his 2004 article entitled "Safety Harnesses: Self-Recovery/Self-Rescue", a then recent Consumer Product Safety Commission (CPSC) report estimated that 6,410 injuries attributed to tree stand use were treated in U.S. hospitals nationwide in 2001. That was based on a review of their National Electronic Injury Surveillance System (NEISS). Their data sources further indicated that there were 137 incidents involving tree stands from 1980 through 2001. Included in these statistics were 62 deaths, 55 injuries, 17 incidents not involving death or injury, and 3 incidents in which the outcome is unknown. Of the 137 incidents, 54 mentioned tree stand failures resulting in 6 of the deaths, 40 injuries, and 8 incidents without injury. There were eight incidents involving hanging or traumatic asphyxiation by a safety belt around the waist or chest that resulted in death. These are only the incidents reported by hospitals; they do not include statistics for incidents that are misclassified but still tree stand related.

The CPSC estimates there may be at least 11 million tree stands in use by hunters. The estimated annual shipments of all manufactured tree stand types could exceed 1.4 million units. The total annual retail sales of all manufactured tree stand types range from $75 million to $150 million. The use of tree stands for hunting has increased dramatically in the past few years. Along with the increase in their use comes an increase in the number of serious or fatal injuries. While firearms related incidents has declined tremendously since mandatory hunter education courses were instituted and blaze orange laws were passed, the number of tree stand related incidents has increased significantly. During 2003, North Carolina Wildlife Resources Commission reported that 75% of their hunting fatalities were due to tree stand accidents.

Tree stands are used by hunters who prefer to hunt from elevated positions to increase their field of view and to decrease the likelihood of detection by game animals on the ground. A tree stand is basically a seat and footrest unit that is either strapped to a tree or its branches, or is part of a free-standing tower design. Several styles of tree stands are available, such as an integral ladder and platform stand, fixed-position stands; and self-climbing stands. Unique features distinguish each style.

Hunters have a variety of features to choose from when selecting tree stands. Key features include portability, bars, chains, straps and rails that affix the seating device to the tree, gun rests, bow rests, outward facing stands, forward facing stands, and multiple-occupancy stands that include a tree stand with a seating capacity for four individuals.

A non-statistical survey conducted by *Deer and Deer Hunting* magazine in 1993 and again in 1999, concluded that the most common reason for falls from elevated hunting positions was due to some type of structural failure. These types of failures included rotted wood, loose nails, nails pulled through boards, broken bands, bolts, ropes, or other attaching devices. There were no statistics presented regarding failures of commercially manufactured tree stands.

Hunters are encouraged through informational and educational campaigns to use fall protection devices to prevent death and serious injuries from falls while hunting from tree stands. A fall protection device is comprised of various components such as straps, belts, buckles and other hardware configured for the purpose of arresting a fall from an elevated position.

Fall protection devices are also referred to as fall restraint systems or fall arrest systems. Fall protection devices work as a system because each component of the device is dependent on other components for operational integrity. The term arrest and restraint can carry nuances of meaning. Instructions provided by one tree stand manufacturer have a warning that states that a full-body harness that is included with the purchase of the tree stand is not intended to arrest a fall, but is intended to restrain a fall. For purposes of this article, a fall protection device is used as an inclusive term for the various types of straps and harnesses worn by hunters to arrest, or stop, a fall. Furthermore, the purpose of a fall protection device is understood to be the stoppage of a fall, not the prevention of a fall.

A safety belt is a single strap or rope, worn either around the waist or chest, with a lanyard that secures the device to an anchor on the tree. The safety belt is sometimes described as a waist belt, chest belt, body belt, safety strap, single strap, or fall arrest belt. While a number of manufacturers include full-body harnesses with the purchase of their tree stands, a few may still provide safety belts with their stands. Safety belts can be purchased separately as an accessory item. Safety belts are among the simplest and least expensive of fall protection devices sold to hunters. Hunters are subject to serious injury using a device around the waist or chest and can become inverted. They can lose consciousness in less than 2-3 minutes. When hunters fall with a belt around the waist or chest, self-recovery or self-rescue may become impossible. In January 1998, the Occupational Safety and Health Administration (OSHA) prohibited the use of safety belts as a personal fall arrest system. The decision to prohibit safety belts around the waist was based on extensive studies showing the hazardous effects of the initial fall impact forces and the pressure exerted on the body by these restraints.

A chest and shoulder harness is basically a safety belt with shoulder straps. Instead of being worn around the waist, it rides across the chest and under the arms. If the hunter lifts their arms above their heads during self-recovery/self-rescue, they are subject to sliding out of the harness. During a fall, static loads in excess of several thousand pounds are placed against the chest which could cause ribs to break and penetrate the lungs or heart causing a fatality. The potential for asphyxiation associated with safety belts, straps, or ropes around the waist or chest is the greatest hazard to hunters.

A full-body or parachute style safety harness includes straps for the pelvic and thigh areas in addition to the shoulder straps. A full-body harness fastens around the hunter in a manner designed to contain the torso and distribute fall arrest forces over the upper thighs, pelvis, chest and shoulders, with means for attaching it to other components or subsystems. It is often referred to as a safety harness, or four-point safety harness. Typically, they include a harness, lanyard, anchorage means and connecting hardware. When properly adjusted and worn, it is nearly impossible for the hunter to be ejected from same. Full-body harnesses are generally more expensive, however.

Many individuals hunt alone in secluded areas and would most likely have to rescue themselves if suspended by a fall restraint system. Recently developed guidelines recommend that hunters immediately attempt a self-recovery or self-rescue when suspended after a fall arrest. Step-by-step procedures for self-rescue are usually included in instructions provided by tree stand and fall restraint systems manufacturers. A video produced by the National Bowhunter Education Foundation and the Treestand Manufacturers Association included with some manufacturer's tree stands suggests that hunters carry a knife to cut themselves out of a harness when suspended after a fall. They also state that once the hunter's body weight is off the harness, he/she should "bear hug" the tree and carefully climb down. Such maneuvering requires considerable physical coordination and strength, however. Additionally, hunters may not be able to react quickly enough to perform a self-recovery or self-rescue maneuver, as in the instance of a tree stand collapse where no handholds are available.

Advising hunters to cut themselves out of a harness may not adequately address another issue of post-fall rescue. Cutting or loosening the straps or otherwise trying to slip out of the fall restraint system is illogical as it introduces another serious hazard. Such straps can slip up the torso and incapacitate the hunter by pinning their arms against the body or cause asphyxiation by exerting pressure on the hunter's chest or neck. In a panic, the hunter could even loosen the straps completely and fall from the harness to the ground.

Some hunters elect to attach a long, ¾ to 1 inch thick line from their hunting height to the ground using a Prussic knot. The Prussic knot is attached to that line so as to allow sliding along its length. A full-body harness then attaches to the long line with a tether or anchor line. When pressure is applied to the knot during a fall, it grips the line and holds the hunter in place. This is a redundant system yet it gives the hunter another option for self-recovery or self-rescue.

Regardless of which type of safety harness the hunter uses while hunting from a tree stand, they should be aware of a condition medical practitioners describe as orthostatic intolerance. Orthostatic intolerance may be defined as "the development of symptoms such as light-headedness, palpitations, tremulousness, poor concentration, fatigue, nausea, dizziness, headache, sweating, weakness and occasionally fainting during upright standing". While in a sedentary position, blood can accumulate in the veins which are commonly called "venous pooling," and cause orthostatic intolerance.

An accumulation of blood in the legs reduces the amount of blood in circulation. The body reacts to this reduction by speeding up the heart rate in order to maintain sufficient blood flow to the brain. If blood supply is significantly reduced, that reaction will not be effective. The body will abruptly slow the heart rate and blood pressure in the arteries will diminish. During severe venous pooling, the reduction in quantity and/or quality (oxygen content) of blood flowing to the brain causes fainting. This reduction also can have an effect on other vital organs such as the kidneys. The kidneys are quite sensitive to blood oxygen. Renal failure can occur with excessive venous pooling. And if these conditions persist, very serious repercussions may develop.

Orthostatic intolerance may still be experienced by hunters using certain fall arrest systems. Following a fall, the hunter may remain suspended in a harness. Sustained immobility may lead to unconsciousness. Depending on the length of time a suspended hunter is unconscious and immobile, and the level of venous pooling, the resulting orthostatic intolerance may lead to serious consequences. While not common, such incidents are often referred to as "harness-induced pathology" or "suspension trauma."

Prolonged suspension in fall arrest systems can cause orthostatic intolerance, which, in turn, leads to serious physical injury. Research indicates that suspension in a fall arrest device can result in more serious consequences in less than 30 minutes. To reduce the risk associated with prolonged suspension, hunters should initiate self-recovery/self-rescue as soon as possible after a fall arrest.

All tree stand safety courses should train hunters to use fall arrest systems and other personal protective equipment correctly. Hunters, who wear fall arrest devices while hunting, and those who may perform rescue activities, should also be trained in: (i) how to ascertain whether their harness is properly fitted and worn, so that it performs as intended; (ii) how orthostatic intolerance/suspension trauma may occur; (iii) the factors that may increase a hunter's risk; (iv) how to recognize the signs and symptoms identified above; and (v) the appropriate rescue procedures and methods to diminish risk while suspended.

The use of belts, straps or ropes around the waist or chest alone is not preferred. A full-body safety harness reduces the likelihood of serious, traumatic injury to hunters. In the not so distant future, devices that just wrap around the hunter's waist or chest may be prohibited with full-body safety harnesses being the only type permitted to save lives.

Safety harness use by hunters has experienced a sharp rise in recent years with the rise in popularity of climbing-type tree-stands. Approximately 90% of deer hunters have hunted from an elevated stand at one time or another. One of the most popular types of stands attaches by a cantilever to the trunk of a tree. It lets its user ascend the tree, often to heights of 35 feet, by alternately moving upper and lower sections of the stand in a sit-and-stand, "ratchet-type" action. Such climbing tree stands depend on their cantilever design to impinge on and grip the tree trunk. Unfortunately, such stands have been prone to sudden and unexpected slippage or upset causing them to fall rapidly down the tree or abruptly shift positions and often causing the stand occupant to lose his or her balance and fall to the ground.

At other times, hunters fall out of their stands after falling asleep, during the climbing operation, or when stepping from a fixed ladder onto the platform of another stand type known as a "lock-on" tree stand. Many hunters who use elevated tree stands will experience a fall at one time or another. A large number of those who fall will sustain serious, often catastrophic injuries, including broken bones, ruptured spleens, internal bleeding, severed arteries, paralysis from spinal injuries, even death.

The use of a safety harness to arrest one's fall from an elevated position is well known. Fall-arresting harnesses are commonly used and even mandated by law in certain commercial and industrial applications, especially for individuals working at elevated heights like ironworkers, arborists, window washers, sign installers, roofers, and others. In recreational sports, including deer hunting, full-body safety harnesses, as well as chest-harnesses, and safety waist-belts, are used as fall-arresting protective devices. However, traditional harnesses lack any provision for the wearer who experiences a fall to gradually and safely descend to the ground or other level of safety. Once suspended by a safety harness, only the most athletic and fit of hunters would have an ability to re-enter their tree stand, or "hug the tree" and shimmy down its trunk. That procedure requires the victim to cut the tether from which he/she is suspended, an incredibly dangerous action that can lead to serious injury or death. Remaining suspended from the tree in a safety harness offers no better long-term survival prospects for the victim, however, due to the considerable danger and risk from suspension trauma that is likely to occur very quickly after a fall.

In the case of belt harnesses, it is not uncommon for asphyxiation to occur less than one hour after becoming suspended. With chest harnesses, the survival time can be a bit longer. While full-body safety harnesses were thought to be safer than belt or chest varieties, the constriction of blood flow to one's lower extremities as a result of suspension in such a harness can lead to serious injury or even death in an amazingly short period of time, in some cases as little as 15 to 30 minutes. Even if a hunter is fortunate enough to be discovered by rescuers in a short period after falling and has not succumbed to the effects of suspension trauma, the danger to both victim and rescuers in getting that individual back down to the ground presents a daunting challenge.

If a person falls in a remote location and finds himself suspended in a harness with no controlled descent capability, the impact of a fall may be prevented. But the victim may still be exposed to a critical, life-threatening emergency situation. Accordingly, there is need for a simple, reliable, yet lightweight and economical emergency descent system for a fall-arresting or other type safety harness. Such a system could be used by hunters, rock climbers, recreational tree climbers, as well as numerous industrial applications like billboard installers, steel erectors, tower constructors, maintenance personnel, roofers, arborists, and the like. Such a system could further provide controlled descent in the event one needs to escape under emergency circumstances from an elevated building location, the upper floor of a multi-story home or office.

Relevant publications to the present invention include: the elastic strap assembly shown in Muhich Published U.S. Patent Application No. 2005/0072632 with its "bungee-like", stretchable rubber portion (element 20 therein); the rigid, hinged arm device of Rizza U.S. Pat. No. 6,523,643; and the D-ring controlled safety harness of Rezmer U.S. Pat. No. 5,052,514.

There is also the tree wrapping for the tree stand of Rittenhouse U.S. Pat. No. 4,493,305; the hunter holding tree arm shown but not described in much detail in Leggett U.S. Pat. No. 4,236,602; the pole wrap, waist belt, clamp and main frame support shown in Johnson U.S. Pat. No. 2,879,830; and the utility worker's safety belt from Jacobs U.S. Pat. No. 1,721,516.

While the safety restraint of Halvorson U.S. Pat. No. 4,951,778 first appears similar to the present invention, there are several, significant differences. First, the latter restraint is marketed as a stand alone product. The present invention, by contrast, is meant to be used in conjunction with a full body, safety harness. The prior art harness provides too much "play"; it cannot keep its user/hunter firmly held back against the tree. It does not sufficiently tighten for doing so. The Halvorson restraint has only a single point of attachment that allows for pivoting with different points that either tighten or loosen. This invention, by contrast, has two points of contact that always tighten no matter in which direction the user leans. The Halvorson harness can be purchased with tethers up to 30 inches long. That would allow its wearer to not only fall off his/her stand but furthermore drop up to three feet from same. With all the user's weight on the diaphragm after falling from his/her stand, survival times greater than 2 minutes are rare. With the present invention, the wearer maintains constant contact with the tree, regardless of whether sitting or standing. One can lose his/her orientation, and possibly even lose their balance, but still stay on the stand and in close body contact with the tree.

SUMMARY OF THE INVENTION

This invention is known as a Tree Stand Safety Belt™ device. It is used to prevent a person from falling out of a tree stand from either a sitting or standing position. One embodiment of the invention comprises three, two inch wide sections of nylon webbing sewn together with plastic buckles for attachment. These are sewn together in such a manner as to create two circular sections joined at multiple regions for better reinforcement.

The device of this invention is first fastened around the trunk of a tree, preferably at or near the user's axilla or upper chest height. With the user/wearer's back against the tree trunk proper, the device's chest straps are placed under the user/wearer's arms and around the front of the chest before being tightly secured. With the device securely and tightly fastened around the tree and the wearer's chest, that wearer is prevented from falling.

The invention further relates to a method of using this safety belt to secure oneself about a tree while sitting or standing on an elevated perch such as a hunting tree stand.

BRIEF DESCRIPTION OF THE DRAWINGS

Further features, objectives and advantages of the present invention will become clearer when referring to the detailed description of preferred embodiments made with reference to the drawings in which.

DETAILED DESCRIPTION OF PREFERRED EMBODIMENTS

A primary object is to provide a tree stand user/hunter with greater assurance that he/she will not fall from the stand once secured to the tree with this invention. A further object is to provide the user/hunter with a tree stand safety belt that allows for slight movement for comfort adjustment but otherwise keeps the user/hunter's body snugly against the tree while either sitting or standing on a secured tree stand. It is another main object to provide a safety belt that is uncomplicated in design yet safely protects its user/wearer from falling out of a stand even in the event of a slight disorientation/imbalance. A still further object is to provide a tree stand safety belt with more than one connector attachment between main circular-shaped belt components. Still another object is to provide a safety belt with no main mechanical elements, like rods, hinges and the like. Still one more object is to provide a flexible safety belt that may be easily and rapidly fitted about most tree trunks while still being able to work in a variety of adult, teen and child user/hunters.

Another object of this invention is to provide a safety belt harness for tree stand users that does not employ just one, central pivot point, like several prior art devices. This invention employs multiple connections between loops of nylon material wrapped tightly about the trunk of a tree and also about the upper chest of its wearer/user. There is meant to be very little movement by the wearer with his/her back firmly against a tree.

When referring to any numerical ranges herein, it should be noted that all numbers within the range, including every fraction or decimal between its stated minimum and maximum, are considered to be designated and disclosed by this description. As such, disclosing a preferred strap width ranging from 1 to 3 inches, covers strap sizes of 1.1, 1.25 and 1.5 inches . . . and so on, up to about 2.75, 2.8 and 2.99 inches. The same applies for every other quantitative range herein.

Figure 1:
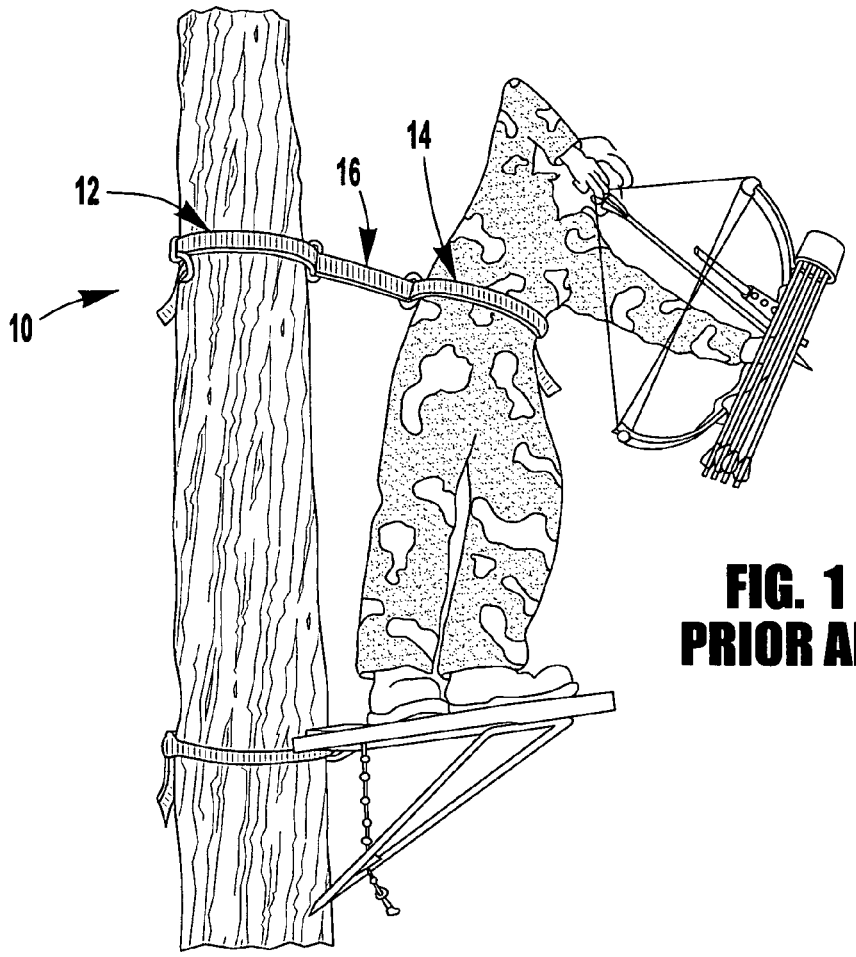
FIG. 1 PRIOR ART
FIG. 1 is a diagrammatic view showing a hunter in a tree stand secured by the PRIOR ART restraint system of Halvorson U.S. Pat. No. 4,951,778.
Figure 2:
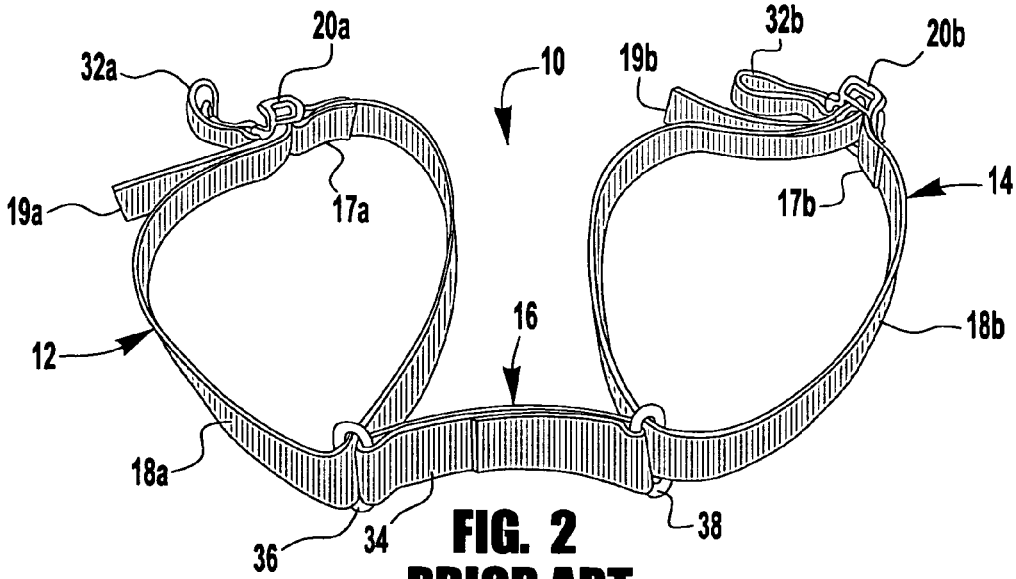
FIG. 2 PRIOR ART
FIG. 2 is a perspective view of the PRIOR ART safety restraint from Halvorson U.S. Pat. No. 4,951,778.

In the prior art device of FIGS. 1 and 2, there is illustrated a safety restraint device 10 for use by hunters in a tree stand. It is the very intent of that device to secure the user to the tree while still allowing same to move about freely without fear of falling from the stand. Restraint device 10 includes a pair of identical members 12 and 14 connected by a connector member 16. Both members 12 and 14 include a strap 18 having first and second ends 17 and 19 and a buckle 20. First end 17 of strap 18 is inserted through an aperture in the buckle 20 before being partially sewn back onto itself thus forming a belt like loop to be placed around the user's waist of a user or around a tree trunk. The buckle 20 and strap 18 allow the user to adjustably secure that device to the tree trunk or user ensuring a good fit to both. The buckle 20 controls the circumference of its belt-like loops.

In the prior art device, strap 18 is made of polypropylene material and stitched with nylon thread at its connection points. Strap 18 is 60 inches in length and 2 inches wide. Cooperatively connected to each of members 12 and 14 is a connector member 16 having a connector strap 34 with first and second links 36 and 38 slidably engaged therewith. Connector strap 34 is made of polypropylene and is 22 inches long.

In operation, prior art device 10 is used as shown in FIG. 1 to anchor its user to a tree while still accommodating some user movement. To operate device 10, the user will remove the free end 19*a* of strap 18*a* from buckle 20*a* before wrapping strap 18*a* around a tree. Free end 19*a* will then be fed into buckle 20*a* and tightened by pulling. The user then loosens strap 18*b* from buckle 20*b* on user member 14 and wraps strap 18*b* around his or her waist before tightening same to a comfortable and secure position. As noted elsewhere, the prior art device allowed its user to turn freely if desirable. It would also allow its user to lean forward, or to the side, for taking aim at game. Unfortunately, in the intervening years, such additional movement possibilities detrimentally impacted the safety usefulness of that device. With a tether that could be up to 30 inches in length, it was possible for users of the prior art device to move so far as to fall out of their tree stands. Unless they could self-correct or obtain help from nearby hunters, they could quickly "dangle" to their demise.

Referring now to FIGS. 3 through 10, there is shown one embodiment of Tree Stand Safety Belt device 50 according to this invention. Device 50 includes three sections of 2 inch wide nylon webbing material, two 2 inch wide, plastic snap buckles and two 2 inch wide tri-fasteners. In one preferred embodiment, one section of nylon webbing (element 52) is 72 inches long while the other two sections (elements 54*a* and *b*, respectively) are each 36 inches long. Each 36-inch section of webbing is sewn to the 72-inch section as described below.

One end of 36-inch section 54*a* is sewn to the 72-inch section 52 at a point beginning about 6 inches from the center C of 72-inch section 52. The non-sewn end of that 36-inch section 54*a* will extend towards the center C of the 72-inch section 52. The sewing is comprised of triple stitching in a vertical and cross configuration extending for about 2 inches with high strength nylon carpet thread. The other 36-inch section 54*b* will be sewn in the same manner from the opposite side of the center C to 72-inch section 52. With both 36-inch sections attached, there will be a 12 inch open space (element 56) on the 72-inch section 52 between the two 36-inch sections 54*a* and *b*.

Figure 3:
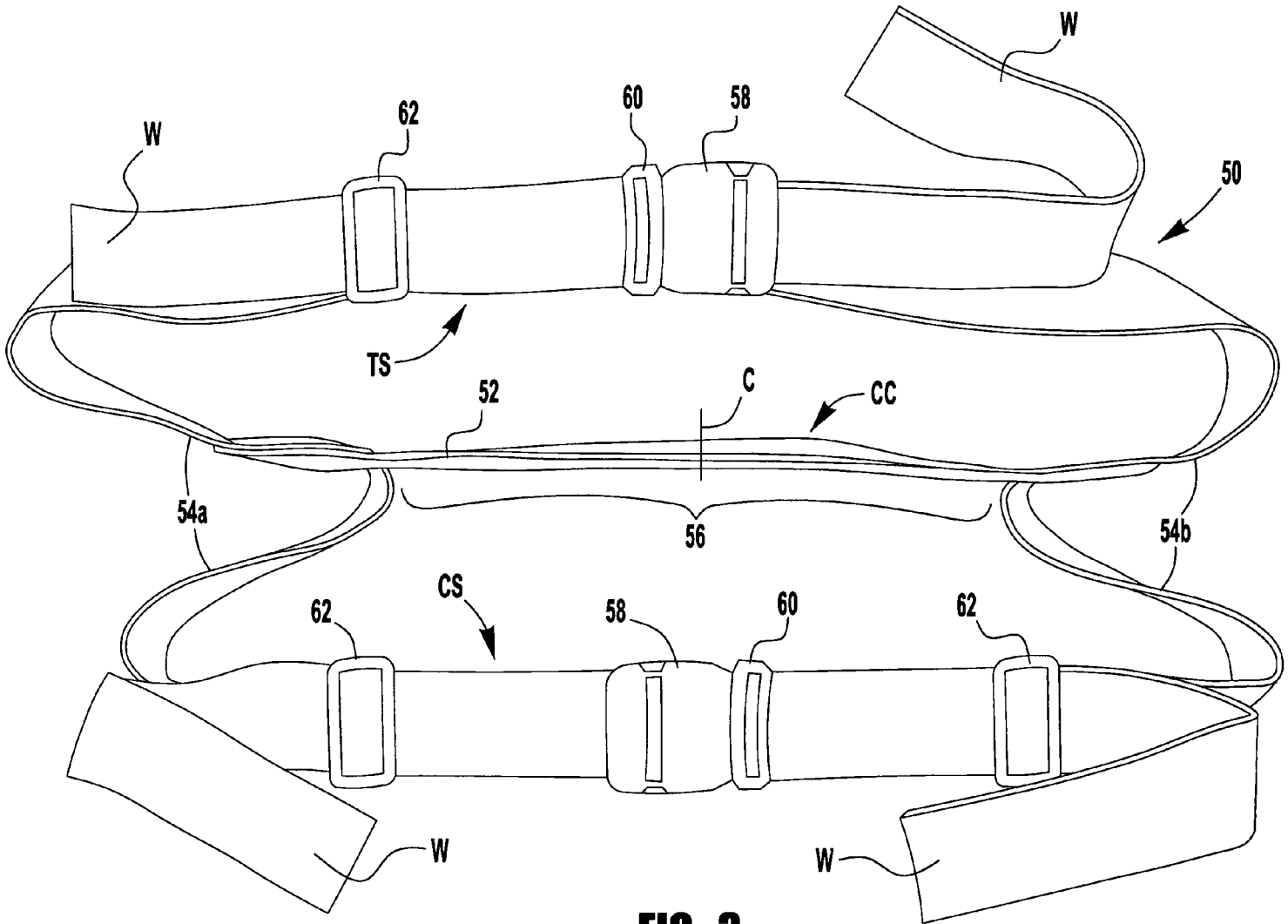
FIG. 3 is a top plan view of one embodiment of this invention with its buckle and fastener pairs both joined together.
Figure 4:
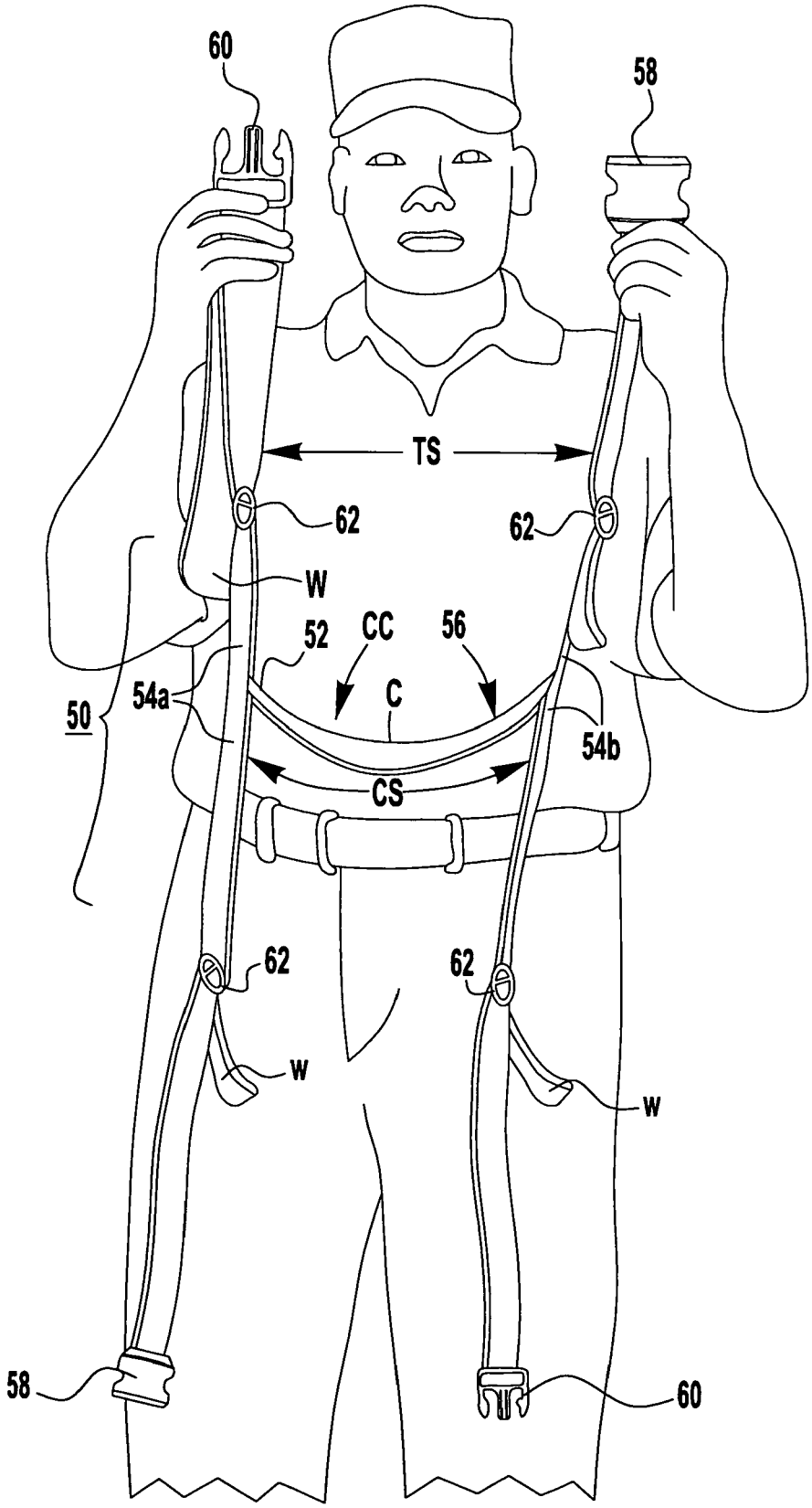
FIG. 4 is a diagrammatic view showing a hunter, holding his safety belt from its two open, upper strap sections, the two lower strap sections also being opened, i.e. unfastened, in this same view.

Two snap buckles (elements 58) and two tri-fasteners (elements 60) are attached to the aforementioned assembly, as best seen in accompanying FIGS. 3 and 4. On various 36-inch section straps, there are included adjustment buckles 62 for slidably engaging along the length of said straps. Altogether, these components render complete the assembly of Tree Stand Safety Belt device 50.

The device proper is divisible into a main chest strap section CS, a main tree strap section TS and short central connector section CC therebetween. Main chest strap section CS is completed by adding one snap buckle 58 to one of the two CS strap halves, and one tri-fastener 60 to the other CS strap half as shown in FIG. 4. Sections of nylon webbing W extend beyond the buckle 58 and tri-fastener 60 for the sectional halves of the chest strap CS to make mostly user size as well as some slight user comfort adjustments.

The tree strap section TS is completed by adding one snap buckle 58 to one of the two TS strap halves, and one tri-fastener 60 to the other TS strap half, also as shown in FIG. 4. In one embodiment, tree strap section TS is made by placing a snap buckle 58 at one end of the 72-inch section 52 and a tri-fastener 60 at its opposite end. In an alternate embodiment, tree strap section TS can be made from one half of the 72-inch section 52 with the other half of tree strap section TS being made from one of the two sections of 36-inch straps (54*a* or *b*) permanently affixed to the 72-inch section 52. Regardless, the central connector section CC needs no snap buckles or tri-fasteners as it is purposefully meant to be non-adjustable with this invention.

Figure 5:
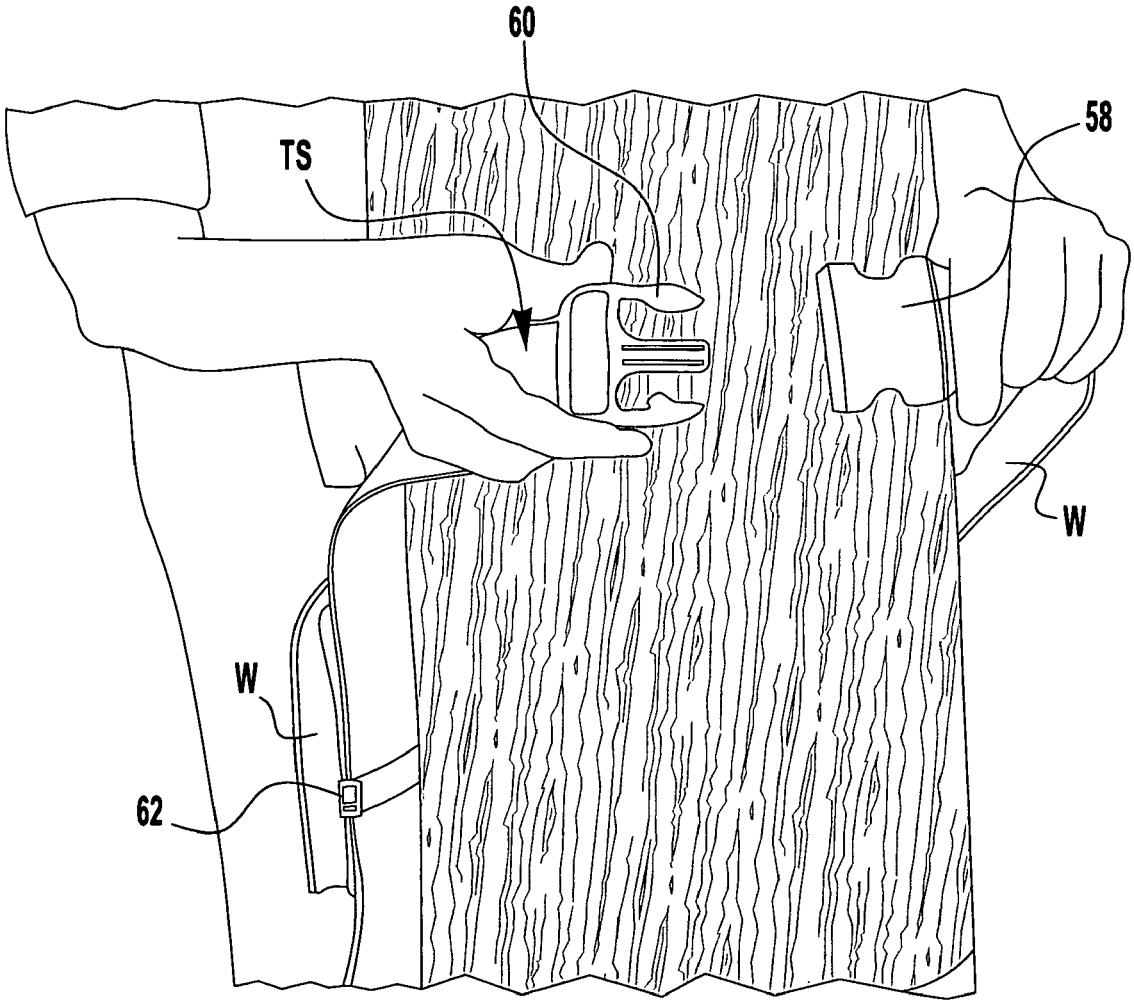
FIG. 5 is a diagrammatic view showing the hunter fastening two strap sections of the invention about the trunk of a tree.
Figure 6:
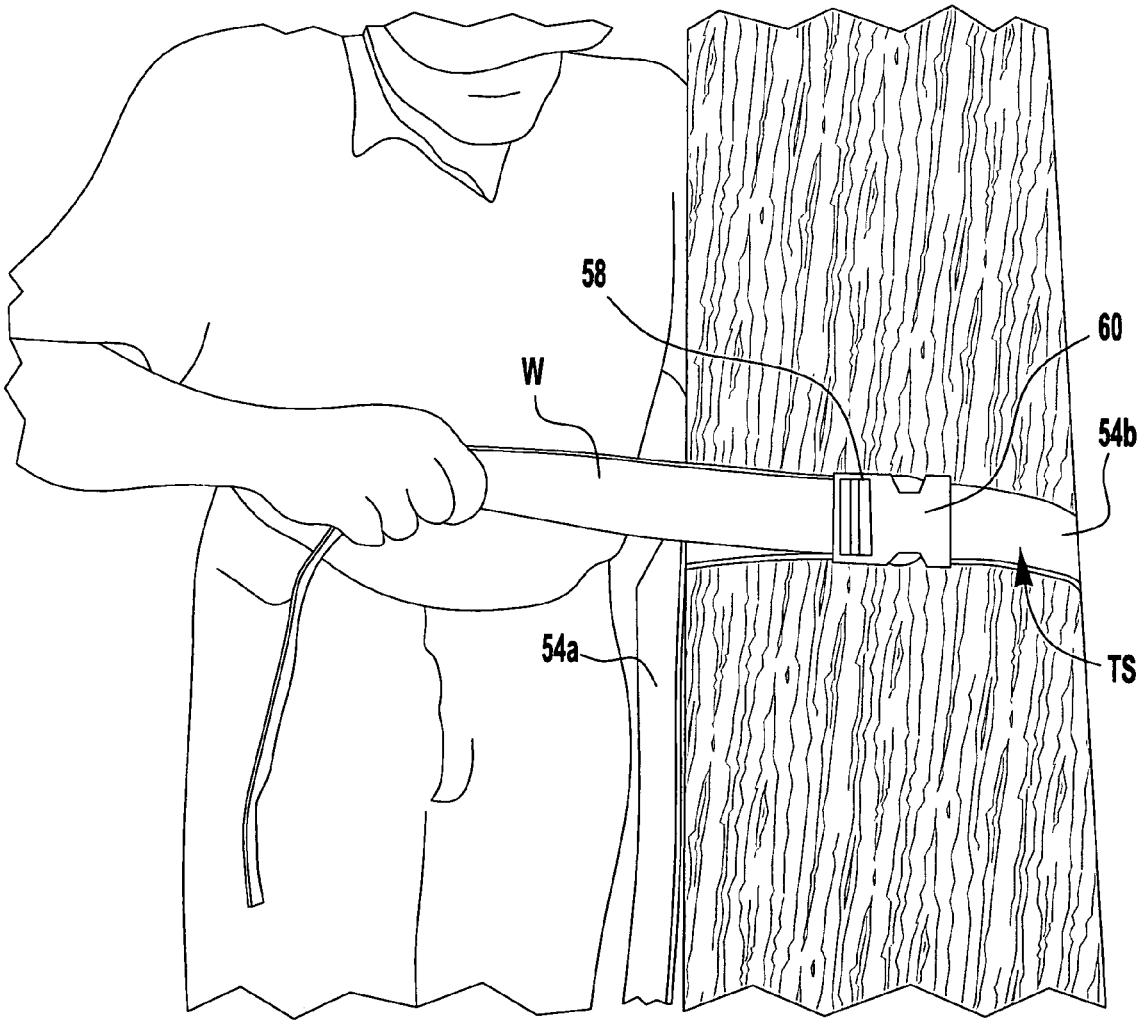
FIG. 6 is a diagrammatic view showing the hunter showing the user pulling the adjustment strap for tightening one end of the device about the tree trunk.
Figure 7:
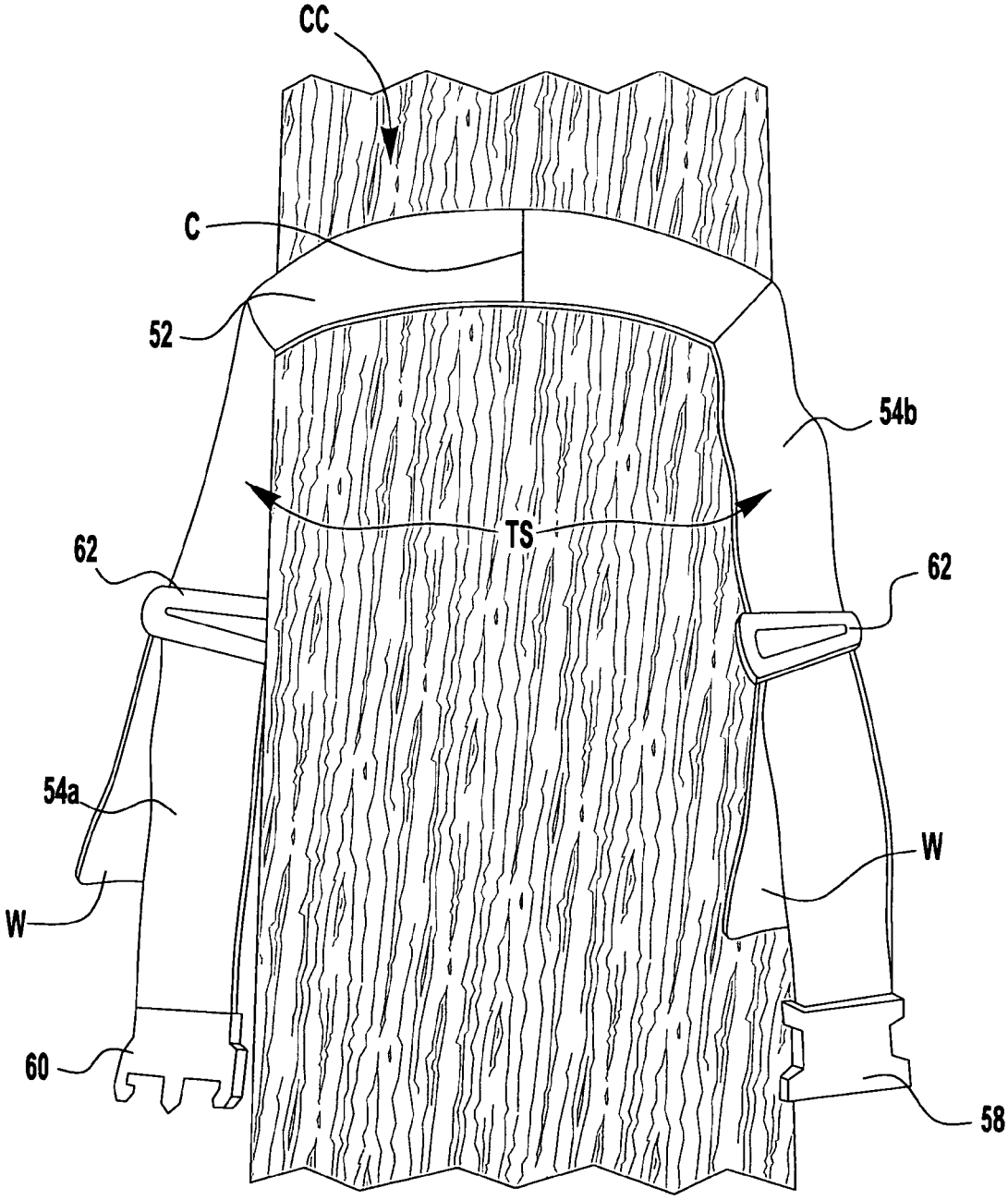
FIG. 7 is a diagrammatic view showing the opposite end of this device after the one end has been fastened about the tree trunk per FIG. 6.

A fully assembled Tree Stand Safety Belt device 50 is attached about the trunk of a tree by holding the two opened halves of tree strap section TS and reaching around the tree trunk for joining snap buckle 58 and tri-fastener 60 together as shown in FIG. 5. The tree strap section TS should be situated at the axilla, or upper chest height, of the wearer/user whether sitting or standing. The tree strap section halves can then be secured to the tree by pulling on the free ends of webbing W to securely tighten the strap (per FIG. 6) so that section TS cannot move or slide. Once the tree strap section TS is secured, the two halves of chest strap section CS will hang in front (or on the opposite side) of the tree as shown in FIG. 7.

Figure 8:
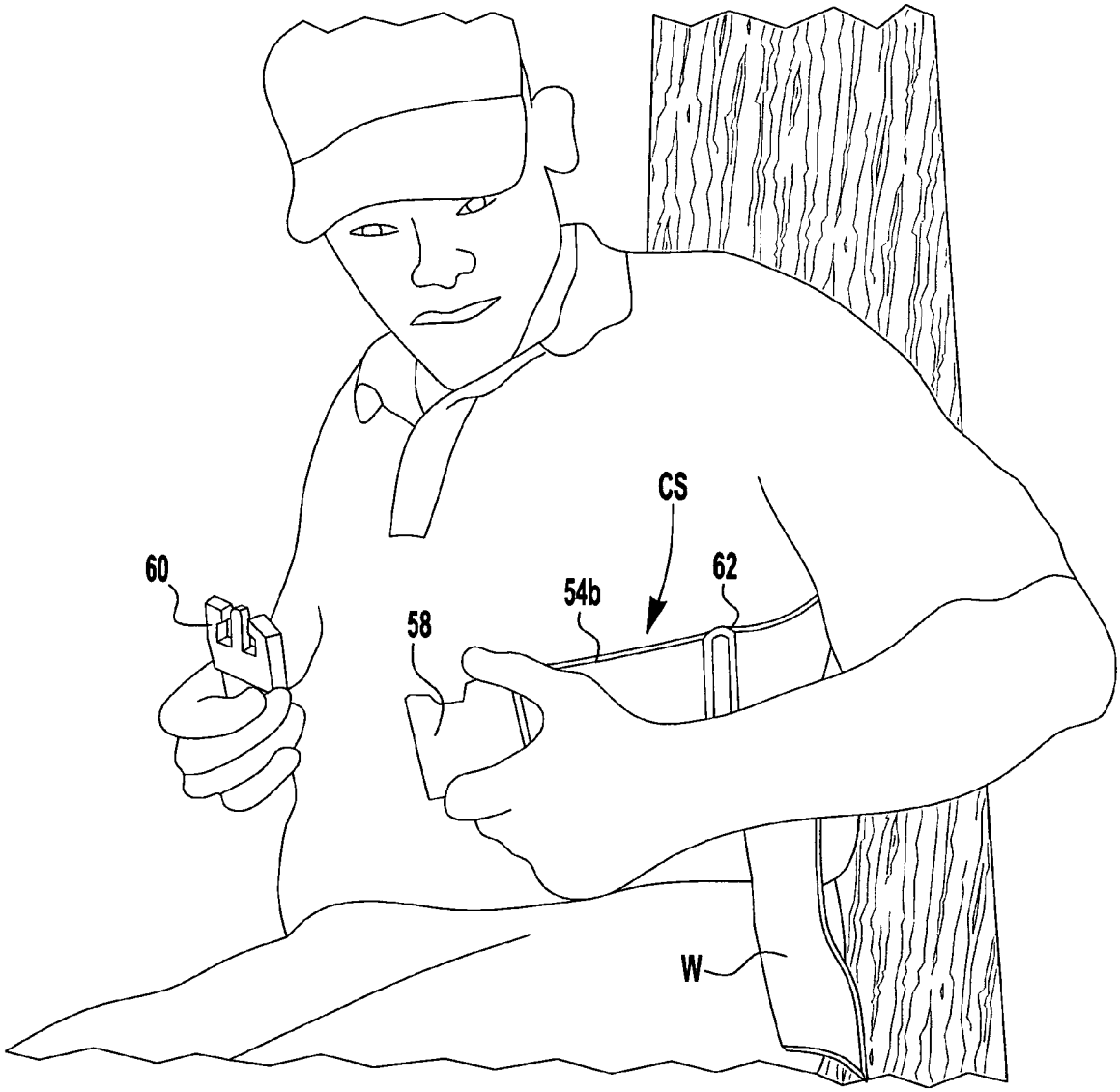
FIG. 8 is a diagrammatic view showing the hunter with his back against the tree trunk bringing the two open end sections for connecting together about his chest or upper torso.
Figure 9:
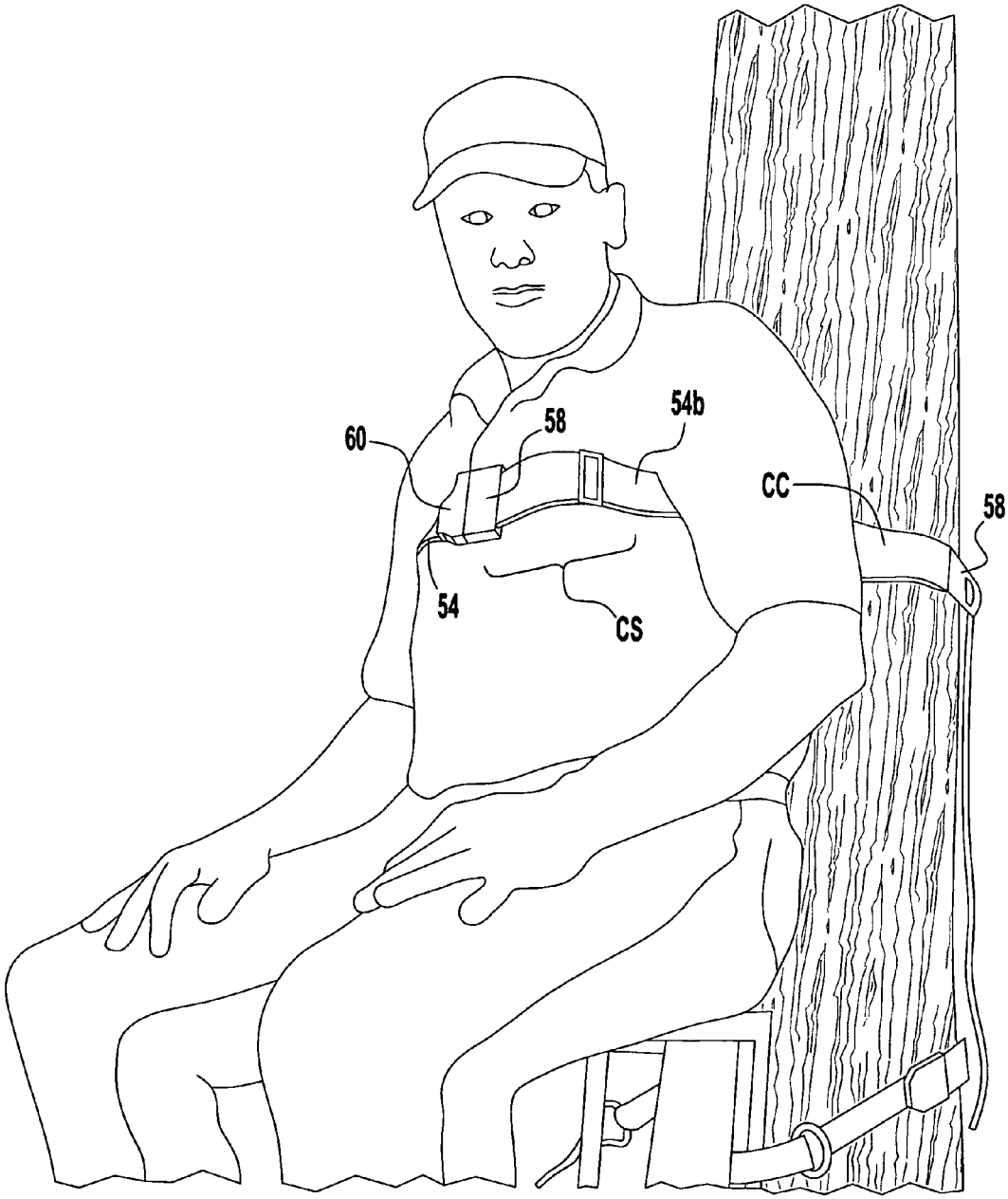
FIG. 9 is a diagrammatic view showing the hunter fully secured with the invention while sitting on a tree stand.
Figure 10:
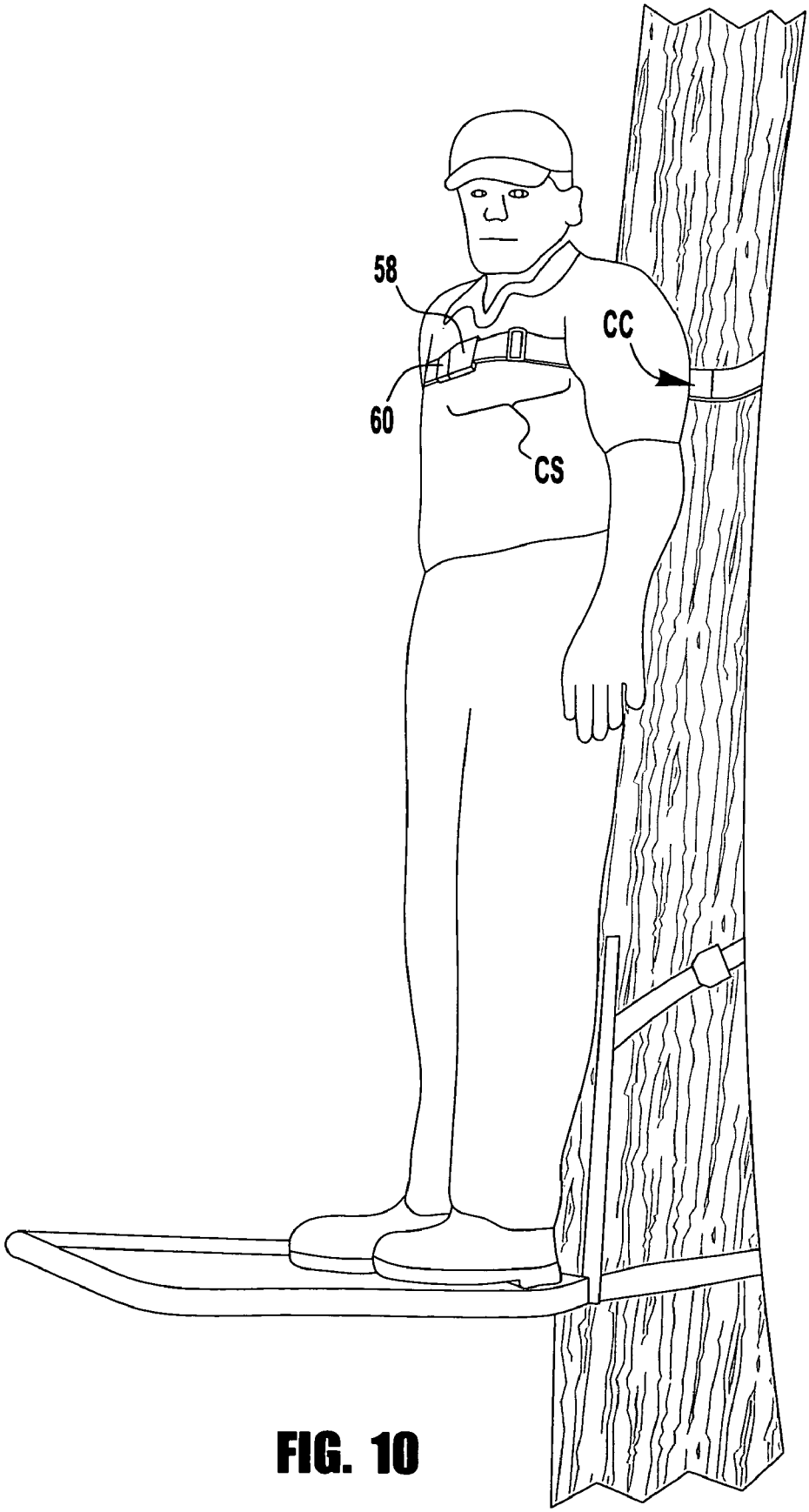
FIG. 10 is a diagrammatic view showing the hunter fully secured with the invention while standing on a tree stand.

A person (wearer/user) then secures him or herself to the device mounted about a tree trunk by first placing his/her back against the tree and pulling the pair of chest strap halves CS under the arms and around to the front of his/her chest for attaching snap buckle 58 to tri-fastener 60 together as shown sequentially in FIGS. 8 and 9. Chest strap CS is then securely tightened around the wearer/user's chest by pulling the slack in the webbing W in a manner similar to that shown in above FIG. 6 for the tree strap TS. Chest strap CS should be securely fastened regardless of the age and weight of the wearer/user. FIG. 9 shows a chest strap CS securely fastened on an adult wearer sitting on his tree stand while FIG. 10 shows the same wearer secured by his chest strap CS in a standing position. Though not shown, the same device 50 can also be worn by teens and small children.

Once secured in this manner, the Tree Stand Safety Belt device of this invention is the only device that prevents its wearer/user from accidentally falling out of a tree stand in either a sitting or standing position. Other known devices merely prevent a person from falling completely to the ground after falling off his/her tree stand. Depending on the length of tether sections for these known devices, their design and relative position on the hunter's body can cause serious injury, even death, from suffocation due to constrictive forces placed on the wearer's abdomen and/or chest after an elevated fall.

As can be seen in the accompanying drawings and as described earlier above, the connecting section of this invention is permanently joined at two points to the tree section and at two points to the chest section. More preferably, one segment of the tree section and one segment of the chest section are made from a common section of nylon webbing.

While the invention has been described with respect to a limited number of embodiments, those skilled in the art, having benefit of this disclosure, will appreciate that other embodiments can be devised which do not depart from the scope of the invention as disclosed here. Accordingly, the scope of the invention should only be limited by the attached claims.

What is claimed is:

1. A tree stand safety belt for securing a user's back against a tree trunk in either a sitting or standing position, said safety belt comprising:

(a) a tree section having two segments for connecting together about the tree trunk at about an upper chest height of the user;

(b) a chest section having two segments for connecting together about the user's upper chest, wherein one segment of the tree section has a buckling end and the other segment has a matching fastening end; and one segment of the chest section has a buckling end and the other segment has a matching fastening end; and (c) a connecting section that is permanently joined at two points to the tree section and at two points to the chest section for not letting the user move about while sitting or standing on the tree stand, said connecting section having no adjustable component, said connecting section being less than 20 inches long, wherein each segment of the tree section and each corresponding segment of the chest section comprise a single length of nylon webbing, wherein the connecting section is joined to each said single length at an intermediate point thereof.

2. The tree stand safety belt of claim 1 wherein the connecting section is less than 15 inches long.

3. The tree stand safety belt of claim 2 wherein the connecting section is about 12 inches long.

4. The tree stand safety belt of claim 1 wherein the tree section segments and the chest section segments include at least one buckle for making secure adjustments after connecting about the tree trunk and the user's upper chest.

5. The tree stand safety belt of claim 1 wherein the connecting section is made of nylon webbing.

6. The tree stand safety belt of claim 5 wherein said nylon webbing is about two inches wide or greater.

* * * * *